US007782290B2

(12) United States Patent
Chen

(10) Patent No.: US 7,782,290 B2
(45) Date of Patent: Aug. 24, 2010

(54) SOURCE DRIVER CIRCUIT AND DISPLAY PANEL INCORPORATING THE SAME

(75) Inventor: Chung-Chun Chen, Hsin-Chu (TW)

(73) Assignee: Au Optronics Corp., Hsin-Chu (TW)

( * ) Notice: Subject to any disclaimer, the term of this patent is extended or adjusted under 35 U.S.C. 154(b) by 652 days.

(21) Appl. No.: 11/768,953

(22) Filed: Jun. 27, 2007

(65) Prior Publication Data

US 2008/0186270 A1 Aug. 7, 2008

(30) Foreign Application Priority Data

Feb. 2, 2007 (TW) ..... 96103964 A

(51) Int. Cl.
*G09G 3/36* (2006.01)

(52) U.S. Cl. ..... 345/99; 345/98; 345/100

(58) Field of Classification Search ..... 345/87–93, 345/98–100

See application file for complete search history.

(56) References Cited

U.S. PATENT DOCUMENTS

| | | | | |
|---|---|---|---|---|
| 5,572,655 | A | 11/1996 | Tuljapurkar et al. | |
| 5,804,987 | A | 9/1998 | Ogawa et al. | |
| 6,459,395 | B1 | 10/2002 | Kida et al. | |
| 6,839,043 | B2 | 1/2005 | Nakajima | |
| 6,894,674 | B2 | 5/2005 | Nakajima et al. | |
| 2001/0007135 | A1 | 7/2001 | Yoon et al. | |
| 2003/0132907 | A1* | 7/2003 | Lee et al. | 345/98 |
| 2004/0104873 | A1* | 6/2004 | Kang et al. | 345/87 |
| 2004/0227713 | A1* | 11/2004 | Sun | 345/98 |
| 2005/0078074 | A1 | 4/2005 | Morita | |
| 2005/0110738 | A1 | 5/2005 | Kim et al. | |
| 2006/0139286 | A1* | 6/2006 | Kida et al. | 345/98 |
| 2006/0290637 | A1* | 12/2006 | Kang et al. | 345/98 |

(Continued)

FOREIGN PATENT DOCUMENTS

CN 1584965 2/2005

(Continued)

OTHER PUBLICATIONS

Taiwanese language office action dated May 27, 2010.

(Continued)

*Primary Examiner*—Amare Mengistu
*Assistant Examiner*—Hong Zhou
(74) *Attorney, Agent, or Firm*—Thomas, Kayden, Horstemeyer & Risley

(57) ABSTRACT

A source driver circuit includes several sampling-transmitting units each including a first sub-latch unit, a second sub-latch unit and a transmission channel set. In a first period, the first sub-latch unit samples first pixel data. In a second period, the second sub-latch unit samples second pixel data. The transmission channel set electrically couples the first sub-latch unit and the second sub-latch unit to a corresponding digital-to-analog converting unit. In the second period, the first sub-latch unit outputs the first pixel data to the corresponding digital-to-analog converting unit via the transmission channel set. In a third period, the second sub-latch unit outputs the second pixel data to the corresponding digital-to-analog converting unit via the transmission channel set.

21 Claims, 12 Drawing Sheets

U.S. PATENT DOCUMENTS

| | | | | |
|---|---|---|---|---|
| 2007/0046612 | A1* | 3/2007 | Okumura et al. | 345/98 |
| 2007/0063959 | A1* | 3/2007 | Iwabuchi et al. | 345/100 |
| 2007/0171176 | A1* | 7/2007 | Kwon et al. | 345/100 |
| 2008/0088561 | A1* | 4/2008 | Kawabe | 345/92 |

FOREIGN PATENT DOCUMENTS

| | | |
|---|---|---|
| TW | 535136 | 6/2003 |
| TW | 200501001 | 1/2005 |
| TW | 1237230 | 8/2005 |

OTHER PUBLICATIONS

English language translation of abstract of TW 200501001 (published Jan. 1, 2005).
English language translation of abstract of TW 1237230 (published Aug. 1, 2005).

* cited by examiner

SOURCE DRIVER CIRCUIT AND DISPLAY PANEL INCORPORATING THE SAME

This application claims the benefit of Taiwan Patent Application Serial No. 096103964, filed Feb. 2, 2007, the subject matter of which is incorporated herein by reference.

BACKGROUND OF THE INVENTION

1. Field of the Invention

The invention relates in general to a source driver circuit and a display panel incorporating the same, and more particularly to a source driver circuit for sampling and latching data in a time-sharing and multiplex manner, and a display panel incorporating the circuit.

2. Description of the Related Art

A low-temperature poly-silicon (LTPS) liquid crystal display is the developing mainstream of the current consumer electronic products, and is mainly applied to a display apparatus owing to its property of high integration and high image quality. Due to the enhancement in the stability of the current manufacturing process and the element property, the practicability of designing complicated circuits in the display apparatus has been greatly increased. In response to the integration trend of the build-in circuit in the display apparatus, simultaneously increasing the integration and the reliability of the image signal processing system provide a more flexible design and a wider application field of the display apparatus.

FIG. 1 (Related Art) is an internal block diagram showing a conventional source driver circuit 100. Referring to FIG. 1, the source driver circuit 100 serving as a build-in image processing circuit of a display apparatus mainly includes a horizontal shift register 108, a stage-by-stage sampling latch circuit 110, a line sequencing latch circuit 120 and a digital-to-analog converting circuit 130. The stage-by-stage sampling latch circuit 110 samples pixel data sent from a timing controller 106 under the control of the horizontal shift register 108. The line sequencing latch circuit 120 temporarily stores the sampled pixel data, and the digital-to-analog converting circuit 130 converts the pixel data into a pixel voltage with a suitable voltage level to be outputted to a pixel array (not shown).

FIG. 2 (Related Art) is an internal block diagram showing the stage-by-stage sampling latch circuit 110 and the line sequencing latch circuit 120 according to the prior art. Referring to FIG. 2, the stage-by-stage sampling latch circuit 110 includes a first sub-latch unit 111, a second sub-latch unit 112 and a third sub-latch unit 113. In a line time, each sub-latch unit samples six bits of pixel data, each of the pixel data DR0 to DR5 represents one bit of red pixel data, each of the pixel data DG0 to DG5 represents one bit of green pixel data and each of the pixel data DB0 to DB5 represents one bit of blue pixel data. Next, in a blanking time after the sampling, the stage-by-stage sampling latch circuit 110 transfers the sampled pixel data to the line sequencing latch circuit 120 so that the pixel data DR0 to DR5 are temporarily stored in a fourth sub-latch unit 124, the pixel data DG0 to DG5 are temporarily stored in a fifth sub-latch unit 125 and the pixel data DB0 to DB5 are temporarily stored in a sixth sub-latch unit 126. Thereafter, the pixel data stored in the fourth to sixth sub-latch units 124 to 126 are simultaneously outputted to the digital-to-analog converting circuit 130 via transmission channel sets 72, 74 and 76, respectively.

The total number of transmission channels required in the conventional source driver circuit 100 equals the product of the number of bits of the pixel data and the resolution of the digital signal. For example, in the mobile phone display having the wide viewing angle display screen (Quad-VGA), 240 (resolution)*18 (number of bits in a pixel)=4320 transmission channels are needed to simultaneously transmit the pixel data to the digital-to-analog converting circuit 130. The great number of transmission channels requires the relative large circuit layout area so that the size of the end product (e.g., the QVGA mobile phone) is large and the end product has the drawback of high power loss.

SUMMARY OF THE INVENTION

The invention is directed to a source driver circuit and a display panel incorporating the same to prevent the great demand on the larger circuit layout area caused by the conventional design method, wherein the source driver circuit and the display panel may be adapted to a display apparatus with reduced area.

According to a first aspect of the present invention, a source driver circuit adapted to a display panel is provided. The source driver circuit includes several digital-to-analog converting units and several sampling-transmitting units. Each sampling-transmitting unit includes a first latch unit, a second latch unit and a transmission channel set. The first latch unit includes a first sub-latch unit and a second sub-latch unit. The first sub-latch unit receives a first input enable signal and a first output enable signal. The second sub-latch unit receives a second input enable signal and a second output enable signal. In a first period, the first and second input enable signals are enabled, and the first and second output enable signals are disabled so that the first sub-latch unit and the second sub-latch unit respectively sample first pixel data and second pixel data.

The second latch unit includes a third sub-latch unit and a fourth sub-latch unit. The third sub-latch unit receives a third input enable signal and a third output enable signal. The fourth sub-latch unit receives a fourth input enable signal and a fourth output enable signal. In a second period, the third and fourth input enable signals are enabled and the third and fourth output enable signals are disabled so that the third sub-latch unit and the fourth sub-latch unit respectively sample third pixel data and fourth pixel data. The transmission channel set electrically couples the first latch unit and the second latch unit to the corresponding digital-to-analog converting unit.

In the second period, the first and second output enable signals are sequentially enabled, and the first and second input enable signals are disabled so that the first sub-latch unit and the second sub-latch unit sequentially output the first pixel data and the second pixel data to the corresponding digital-to-analog converting unit via the transmission channel set. In a third period, the third and fourth output enable signals are sequentially enabled and the third and fourth input enable signals are disabled so that the third sub-latch unit and the fourth sub-latch unit sequentially output the third pixel data and the fourth pixel data to the corresponding digital-to-analog converting unit via the transmission channel set.

According to a second aspect of the present invention, a display panel including a pixel array, a timing controller, a vertical driver circuit and a source driver circuit is provided. The pixel array includes several row pixels. The timing controller generates a clock signal, a first actuating signal and a second actuating signal. The vertical driver circuit is electrically coupled to one side of the pixel array and sequentially provides a scan voltage to the row pixels to turn on the corresponding pixel.

The source driver circuit is electrically coupled to the other side of the pixel array and includes several digital-to-analog converting units and several sampling-transmitting units. Each sampling-transmitting unit includes a first latch unit, a second latch unit and a transmission channel set. The first latch unit includes a first sub-latch unit and a second sub-latch unit. The first sub-latch unit receives a first input enable signal and a first output enable signal. The second sub-latch unit receives a second input enable signal and a second output enable signal. In a first period, the first and second input enable signals are enabled and the first and second output enable signals are disabled so that the first sub-latch unit and the second sub-latch unit sample first pixel data and second pixel data.

The second latch unit includes a third sub-latch unit and a fourth sub-latch unit. The third sub-latch unit receives a third input enable signal and a third output enable signal, and the fourth sub-latch unit receives a fourth input enable signal and a fourth output enable signal. In a second period, the third and fourth input enable signals are enabled and the third and fourth output enable signals are disabled so that the third sub-latch unit and the fourth sub-latch unit respectively sample third pixel data and fourth pixel data. The transmission channel set electrically couples the first latch unit and the second latch unit to the corresponding digital-to-analog converting unit.

In the second period, the first and second output enable signals are sequentially enabled and the first and second output enable signals are disabled so that the first sub-latch unit and the second sub-latch unit sequentially output the first pixel data and the second pixel data to the corresponding digital-to-analog converting unit via the transmission channel set. In a third period, the third and fourth output enable signals are sequentially enabled and the third and fourth input enable signals are disabled so that the third sub-latch unit and the fourth sub-latch unit are sequentially enabled to sequentially output the third pixel data and the fourth pixel data to the corresponding digital-to-analog converting unit via the transmission channel set.

According to a third aspect of the present invention, a source driver circuit adapted to a display panel is provided. The source driver circuit includes several digital-to-analog converting units and several sampling-transmitting units. Each sampling-transmitting unit includes a first sub-latch unit, a second sub-latch unit and a transmission channel set. The first sub-latch unit receives a first input enable signal and a first output enable signal. In a first period, the first input enable signal is enabled and the first output enable signal is disabled so that the first sub-latch unit samples first pixel data. The second sub-latch unit receives a second input enable signal and a second output enable signal. In a second period, the second input enable signal is enabled and the second output enable signal is disabled so that the second sub-latch unit samples second pixel data. The transmission channel set electrically couples the first sub-latch unit and the second sub-latch unit to the corresponding digital-to-analog converting unit.

In the second period, the first output enable signal is enabled and the first input enable signal is disabled so that the first sub-latch unit outputs the first pixel data to the corresponding digital-to-analog converting unit via the transmission channel set. In a third period, the second output enable signal is enabled and the second input enable signal is disabled so that the second sub-latch unit outputs the second pixel data to the corresponding digital-to-analog converting unit via the transmission channel set.

The invention will become apparent from the following detailed description of the preferred but non-limiting embodiment. The following description is made with reference to the accompanying drawings.

DETAILED DESCRIPTION OF THE INVENTION

Figure 3:
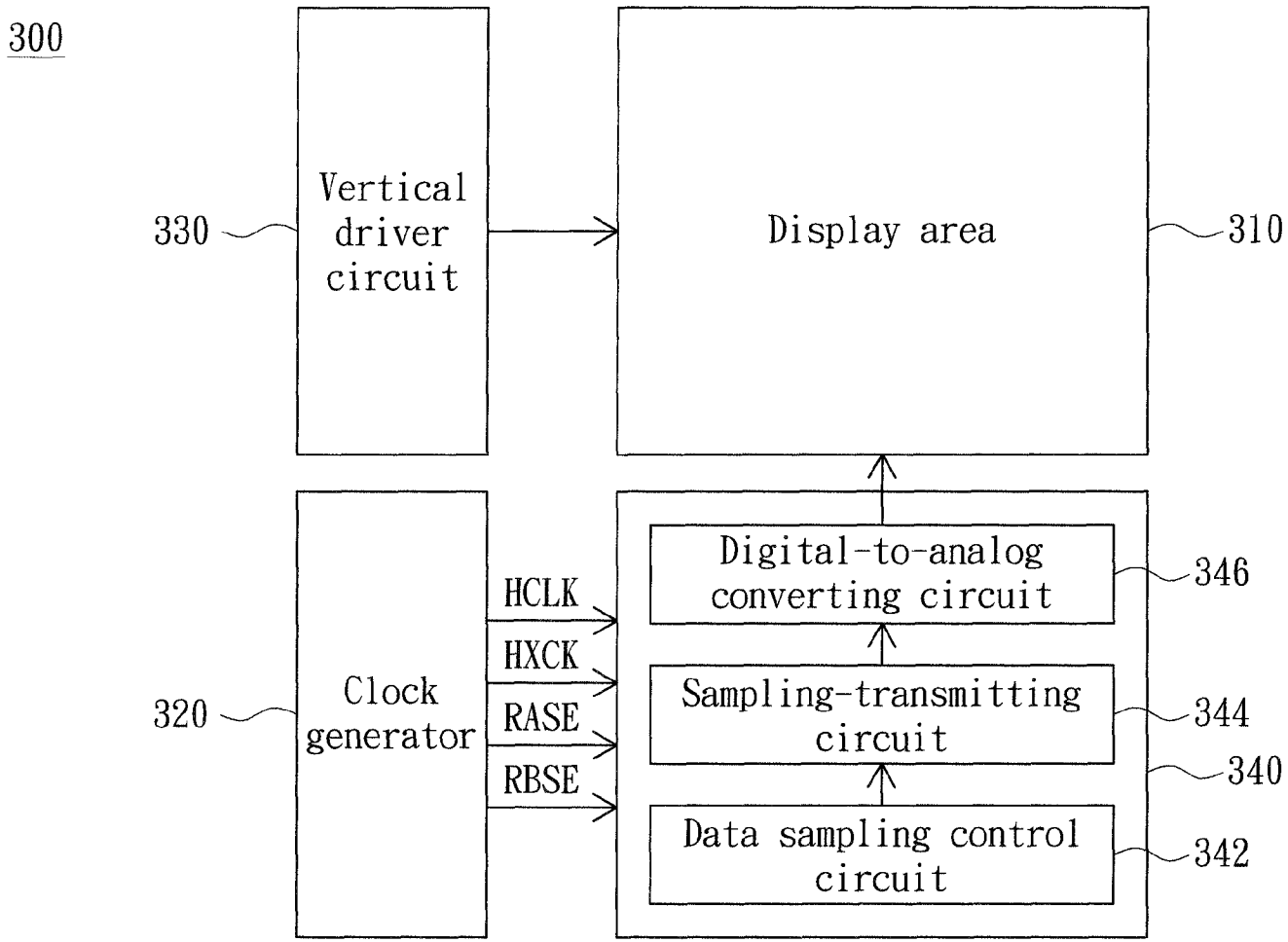
FIG. 3 is a schematic illustration showing a liquid crystal display panel according to a preferred embodiment of the invention.

FIG. 3 is a schematic illustration showing a liquid crystal display panel 300 according to a preferred embodiment of the invention. Referring to FIG. 3, the liquid crystal display panel 300 includes a display area 310 having multiple rows and columns of pixels, a timing controller 320, a vertical driver circuit 330 and a source driver circuit 340. The timing controller 320 generates clock signals HCLK and HXCK, a first actuating signal RASE and a second actuating signal RBSE. The vertical driver circuit 330 is electrically coupled to one side of the display area 310 and sequentially provides a scan voltage to the rows of pixels to turn on the corresponding pixels. The source driver circuit 340 is electrically coupled to the other side of the display area 310 and includes a data sampling control circuit 342, a sampling-transmitting circuit 344 and a digital-to-analog converting circuit 346.

Figure 4:
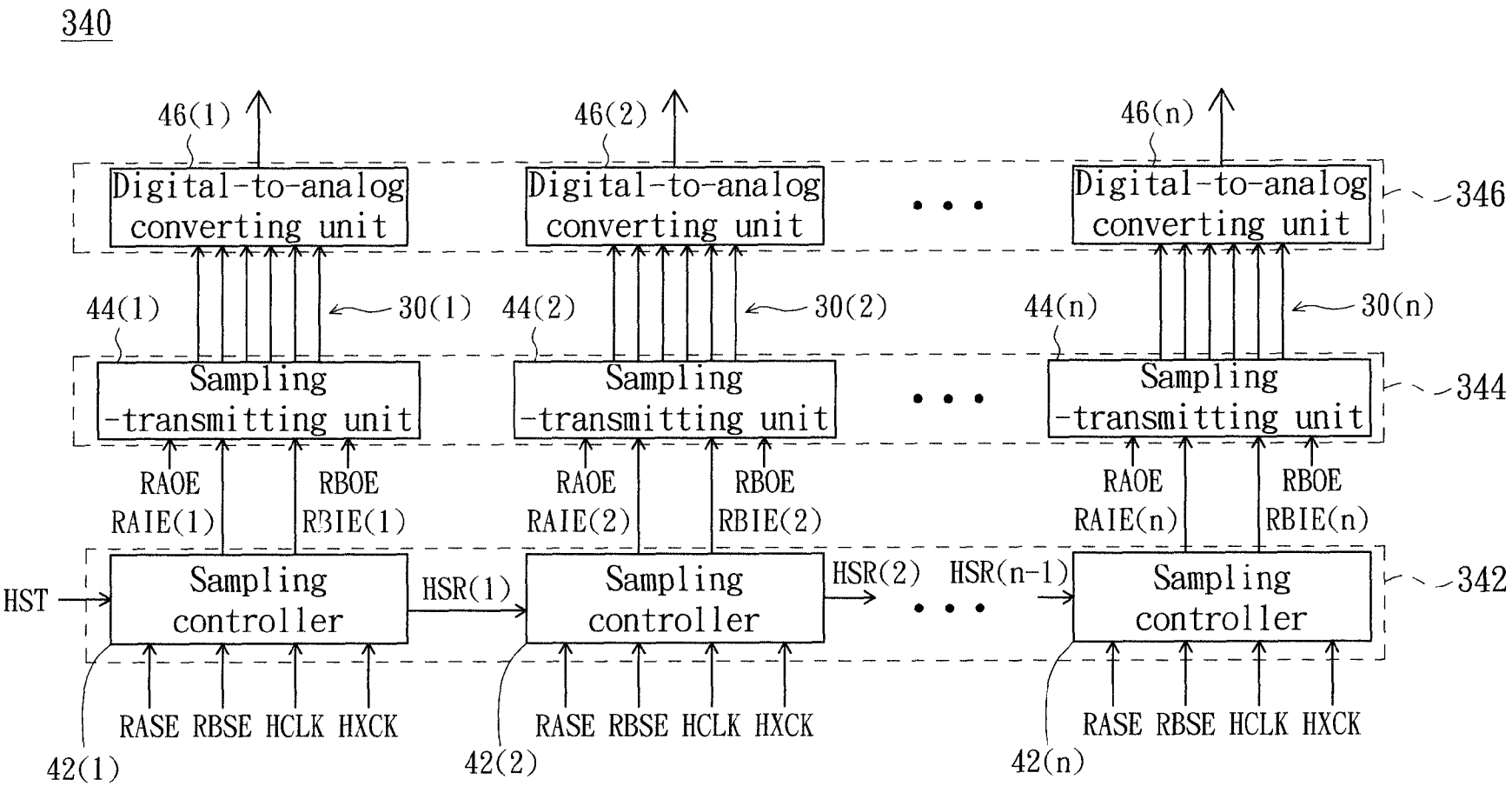
FIG. 4 is a block diagram showing a source driver circuit according to the preferred embodiment of the invention.

FIG. 4 is a block diagram showing a source driver circuit according to the preferred embodiment of the invention. Referring to FIG. 4, the data sampling control circuit 342 includes N data sampling controllers 42(1) to 42(*n*), the sampling-transmitting circuit 344 includes N sampling-transmitting units 44(1) to 44(*n*), and the digital-to-analog converting circuit 346 includes N digital-to-analog converting units 46(1) to 46(*n*). As shown in FIG. 4, each data sampling controller is electrically connected to the corresponding sampling-transmitting unit, and each sampling-transmitting unit is electrically connected to the corresponding digital-to-analog converting unit.

For example, the data sampling controller 42(1) receives the clock signals HCLK and HXCK, a starting signal HST, the first actuating signal RASE and the second actuating signal RBSE, and generates a shift register signal HSR(1) and input enable signals RAIE(1) and RBIE(1) according to these signals. The data sampling controller 42(1) outputs the shift register signal HSR(1) to the next stage of the data sampling controller 42(2) and outputs the input enable signals RAIE(1) and RBIE(1) to the sampling-transmitting unit 44(1). How the source driver circuit 340 of the invention processes the pixel data in a time-sharing and multiplex manner will be described in the following.

Figure 5A:
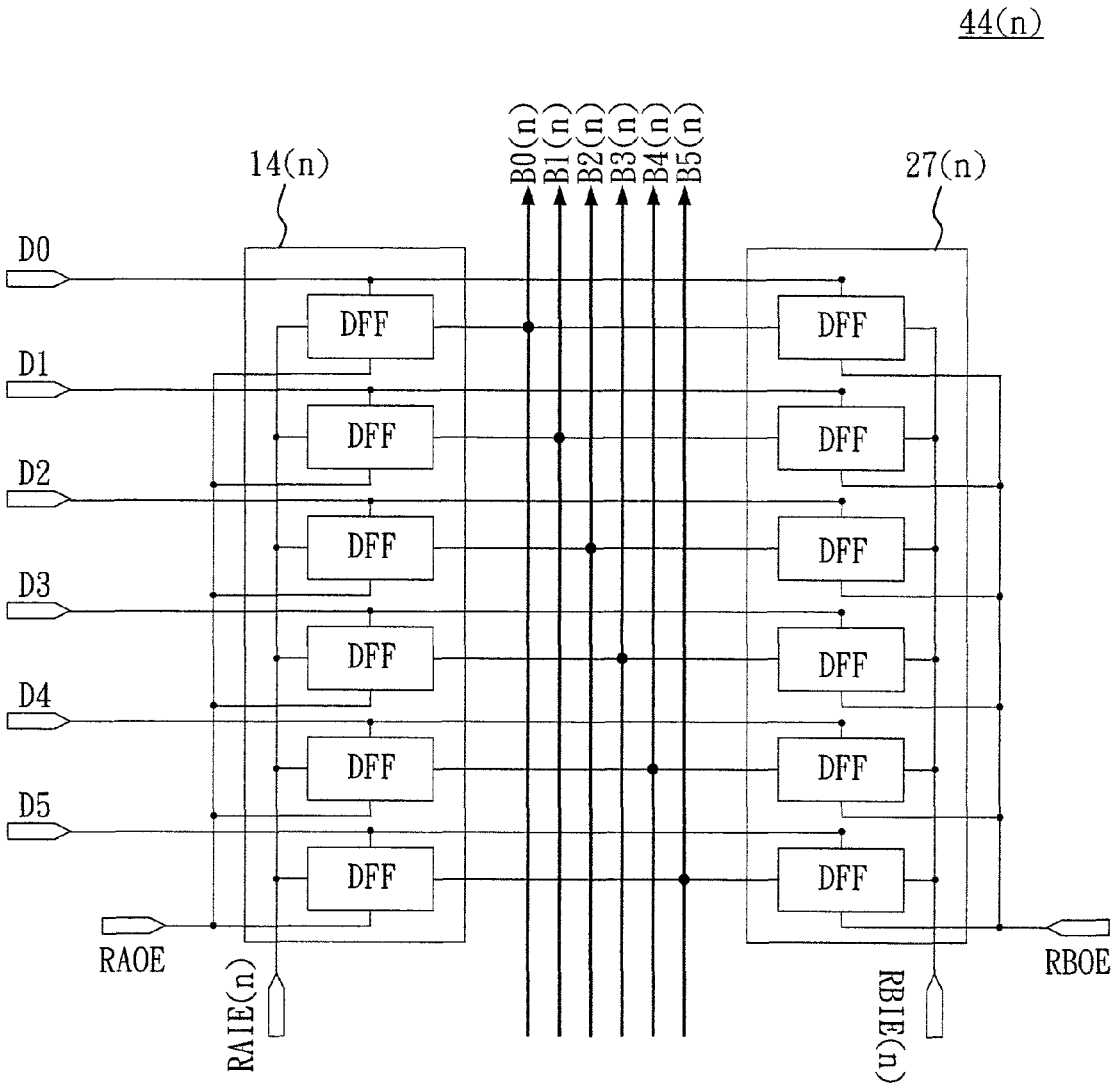
FIG. 5A is a circuit diagram showing a first example of the implementation of a sampling-transmitting unit according to this embodiment.

FIG. 5A is a circuit diagram showing a first example of the implementation of the sampling-transmitting unit according to this embodiment. Referring to FIG. 5A, each sampling-transmitting unit includes a first sub-latch unit, a second sub-latch unit and a transmission channel set. Illustrations will be made by taking the sampling-transmitting unit 44(*n*) as an example. The sampling-transmitting unit 44(*n*) includes a first sub-latch unit 14(*n*), a second sub-latch unit 27(*n*) and a transmission channel set. The transmission channel set includes transmission channels B0(*n*) to B5(*n*). The first sub-latch unit 14(*n*) receives the first input enable signal RAIE(n) and the first output enable signal RAOE. The second sub-latch unit 27(*n*) receives the second input enable signal RBIE (n) and the second output enable signal RBOE. The transmission channel set electrically couples the first sub-latch unit 14(*n*) and the second sub-latch unit 27(*n*) to the corresponding digital-to-analog converting unit 46(*n*).

Figure 5B:
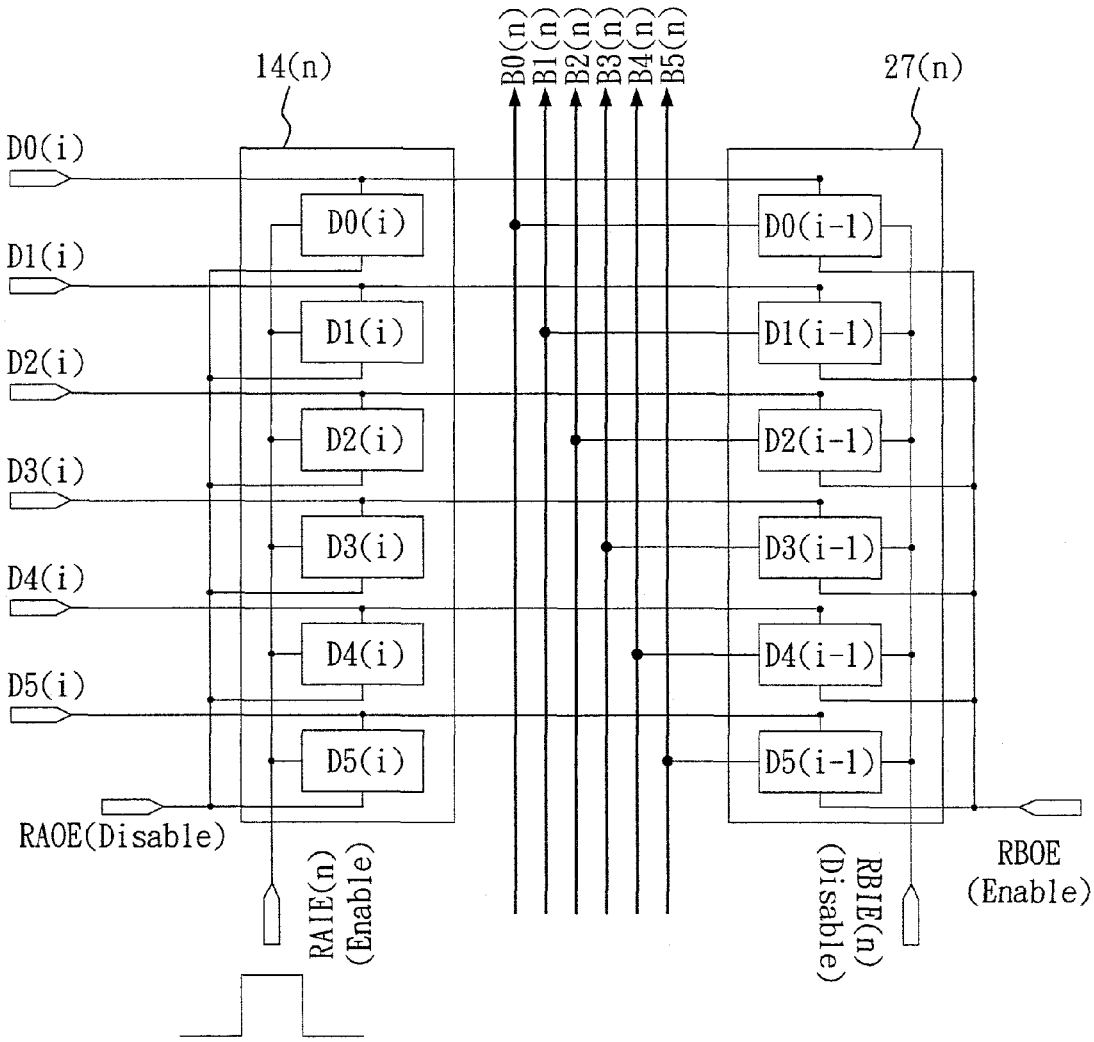
FIG. 5B is a schematic illustration showing the sampling-transmitting unit of FIG. 5A in the first period.

FIG. 5B is a schematic illustration showing the sampling-transmitting unit of FIG. 5A in the first period. In the first period, the first input enable signal RAIE(n) is enabled and the first output enable signal RAOE is disabled so that the first sub-latch unit 14(*n*) samples the first pixel data D0(*i*) to D5(*i*). In this first period, the second output enable signal RBOE is enabled and the second input enable signal RBIE(n) is disabled so that the second sub-latch unit outputs the pixel data D0(*i*−1) to D5(*i*−1) to the corresponding digital-to-analog converting unit 46(*n*) via the transmission channels B0(*n*) to B5(*n*).

Figure 5C:
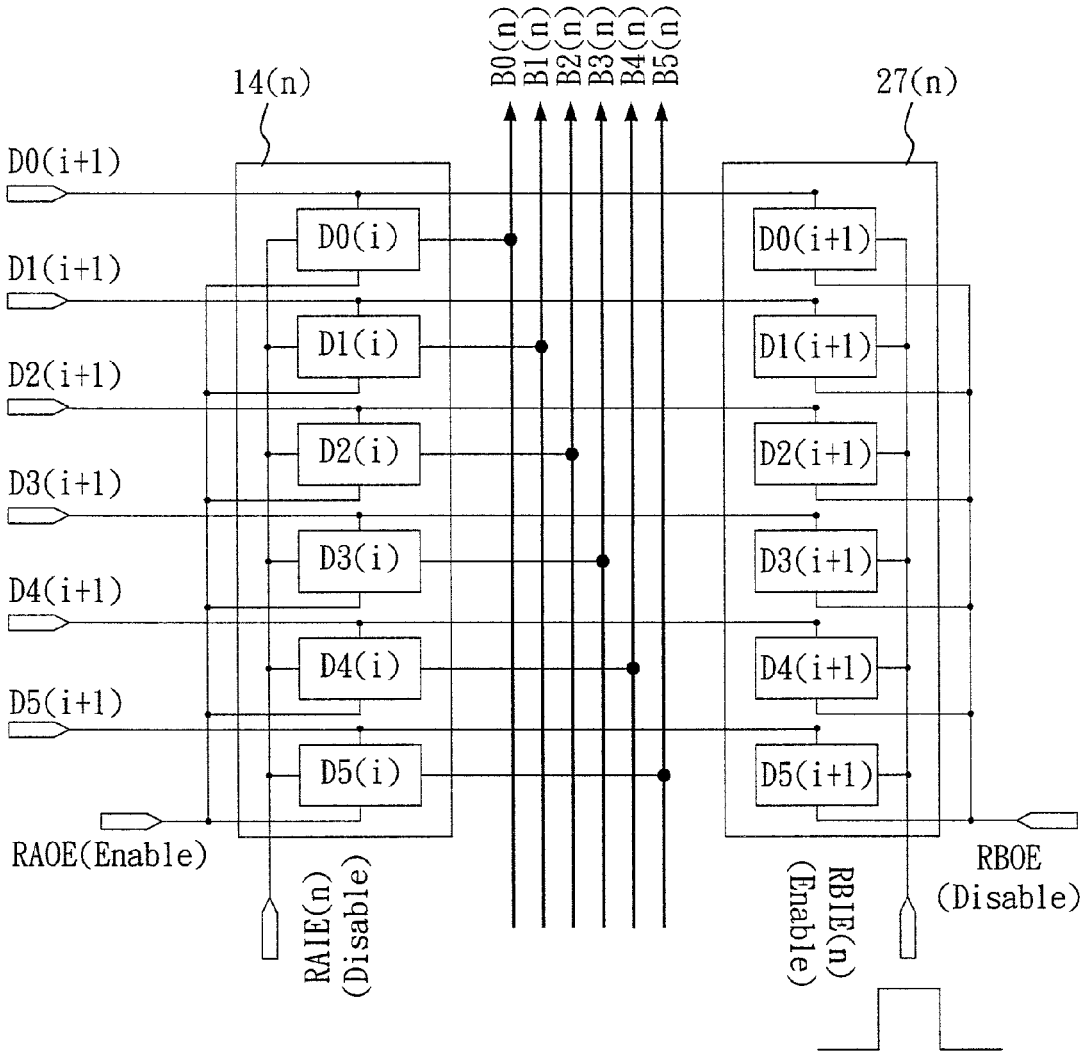
FIG. 5C is a schematic illustration showing the sampling-transmitting unit of FIG. 5A in the second period.

FIG. 5C is a schematic illustration showing the sampling-transmitting unit of FIG. 5A in the second period. In the second period, the second input enable signal RBIE is enabled and the second output enable signal RBOE is disabled so that the second sub-latch unit 27(*n*) samples the second pixel data D0(*i*+1) to D5(*i*+1). In this second period, the first output enable signal RAOE is enabled and the first input enable signal RAIE(n) is disabled so that the first sub-latch unit 14(*n*) outputs the first pixel data D0(*i*) to D5(*i*) to the corresponding digital-to-analog converting unit 46(*n*) via the transmission channels B0(*n*) to B5(*n*).

Figure 6:
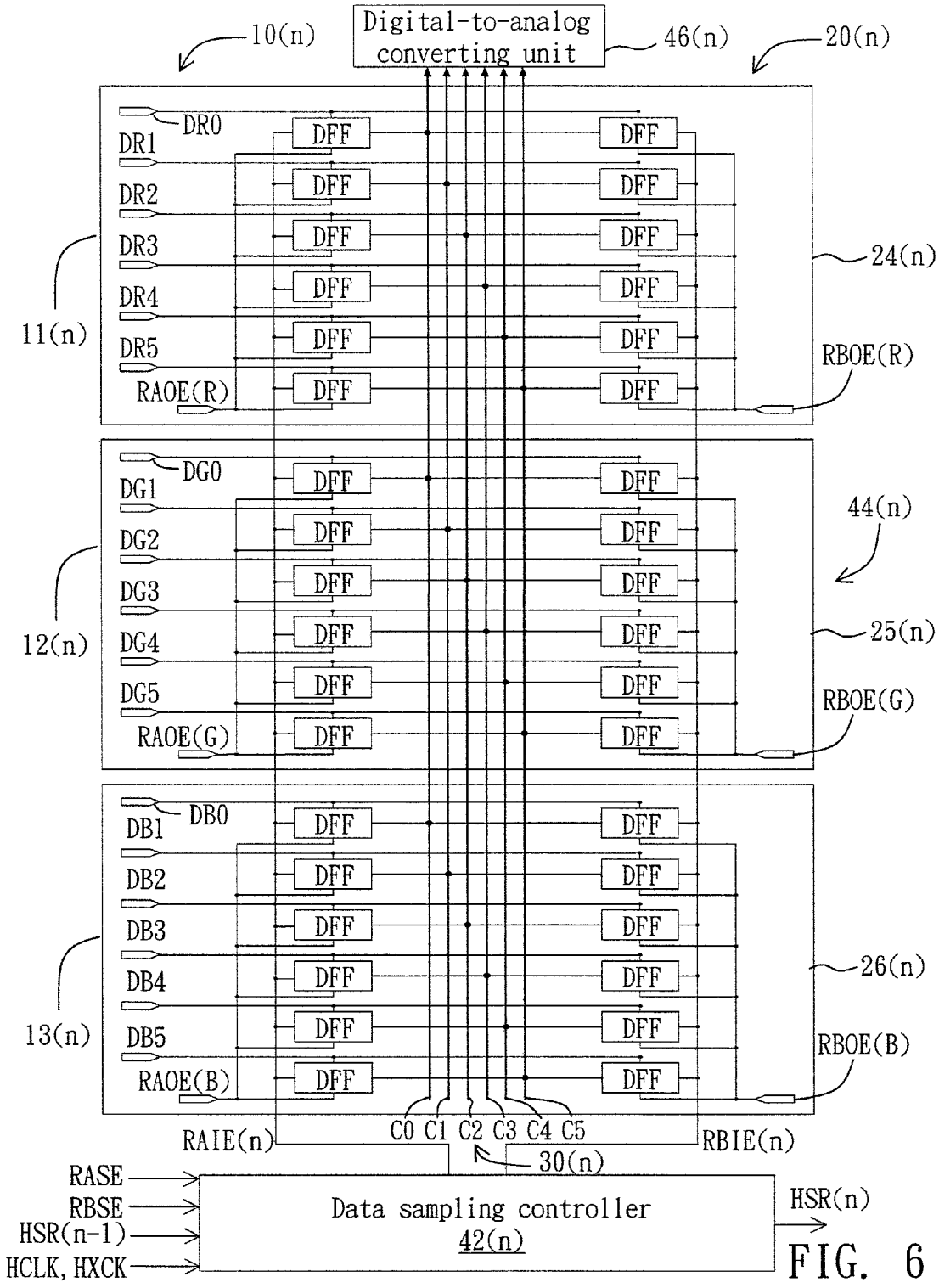
FIG. 6 is a circuit diagram showing a second example of the implementation of the sampling-transmitting unit according to this embodiment.

FIG. 6 is a circuit diagram showing a second example of the implementation of the sampling-transmitting unit according to this embodiment. In this example, each sampling-transmitting unit includes a first latch unit and a second latch unit. The first latch unit includes at least two sub-latch units, and the second latch unit also includes at least two sub-latch units. Illustrations will be made by taking the data sampling controller 42(*n*), the sampling-transmitting unit 44(*n*) and the digital-to-analog converting unit 46(*n*) as an example, in which each of the first latch unit and the second latch unit includes, for example, three sub-latch units.

The sampling-transmitting unit 44(*n*) includes a first latch unit 10(*n*), a second latch unit 20(*n*) and a transmission channel set 30(*n*). The first latch unit 10(*n*) includes a sub-latch unit 11(*n*), a sub-latch unit 12(*n*) and a sub-latch unit 13(*n*). The second latch unit 20(*n*) includes a sub-latch unit 24(*n*), a sub-latch unit 25(*n*) and a sub-latch unit 26(*n*). The sub-latch unit 11(*n*) receives an input enable signal RAIE(n) and an output enable signal RAOE(R), the sub-latch unit 12(*n*) receives the input enable signal RAIE(n) and an output enable signal RAOE(G), and the sub-latch unit 13(*n*) receives the input enable signal RAIE(n) and an output enable signal RAOE(B). The sub-latch unit 24(*n*) receives an input enable signal RBIE(n) and an output enable signal RBOE(R), the sub-latch unit 25(*n*) receives the input enable signal RBIE(n) and an output enable signal RBOE(G), and the sub-latch unit 26(*n*) receives the input enable signal RBIE(n) and an output enable signal RBOE(B).

Each of the sub-latch units 11(*n*) to 13(*n*) and 24(*n*) to 26(*n*) has several memory cells, such as D-flip flops (DFF) or latches. Taking six flip flops for example. Each D-flip flop receives the corresponding bit of pixel data. The transmission channel set 30(*n*) electrically couples the first latch unit 10(*n*) and the second latch unit 20(*n*) to the digital-to-analog converting unit 46(*n*). The transmission channel set 30(*n*) includes several transmission channels, such as six transmission channels in this example. The six transmission channels are correspondingly electrically coupled to the six D-flip flops of the sub-latch units 11(*n*), 12(*n*), 13(*n*), 24(*n*), 25(*n*) and 26(*n*). The first DFFs of all the sub-latch units 11(*n*), 12(*n*), 13(*n*), 24(*n*), 25(*n*) and 26(*n*) are electrically coupled to the same transmission channel, the second DFFs of all the sub-latch units 11(*n*), 12(*n*), 13(*n*), 24(*n*), 25(*n*) and 26(*n*) are electrically coupled to the same transmission channel, and the third to sixth DFFs of all the sub-latch units 11(*n*), 12(*n*), 13(*n*), 24(*n*), 25(*n*) and 26(*n*) are respectively electrically coupled to the corresponding transmission channels.

The first DFFs of the sub-latch units 11(*n*) and 24(*n*) are electrically coupled to the same data transmission cable, such as the data transmission cable for transmitting pixel data DR0. The second DFFs of the sub-latch units 11(*n*) and 24(*n*) are electrically coupled to the same data transmission cable, and the third to sixth DFFs of the sub-latch units 11(*n*) and 24(*n*) are respectively electrically coupled to the same data transmission cables. The six DFFs of the sub-latch units 12(*n*) and 25(*n*) are respectively electrically coupled to the same data transmission cables, and the six DFFs of the sub-latch units 13(*n*) and 26(*n*) are respectively electrically coupled to the same data transmission cables.

Figure 7A:
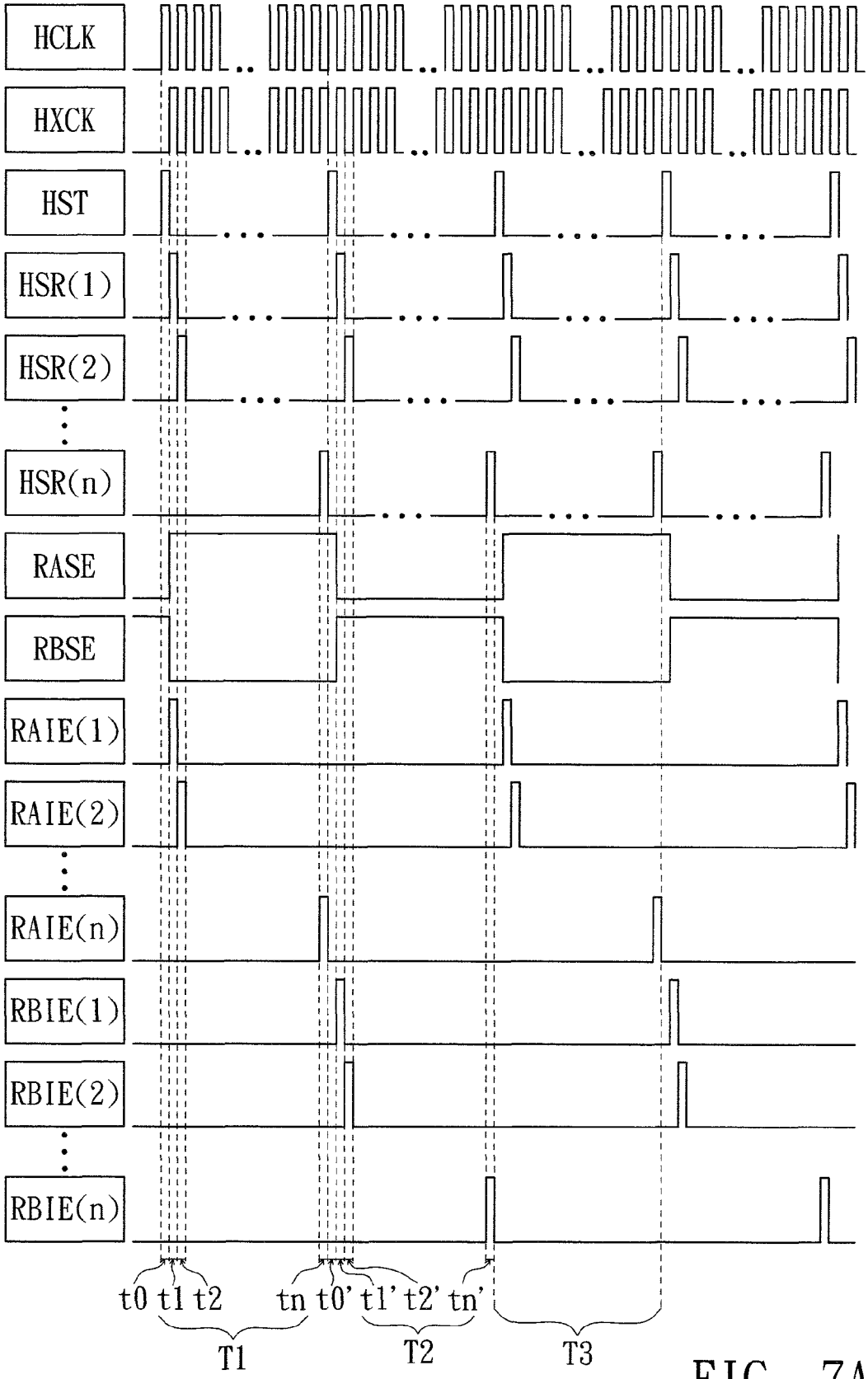
FIG. 7A is a timing chart showing clock signals, a starting signal, shift register signals, a first enable signal, a second enable signal and input enable signals according to an example of the preferred embodiment of the invention.
Figure 7B:
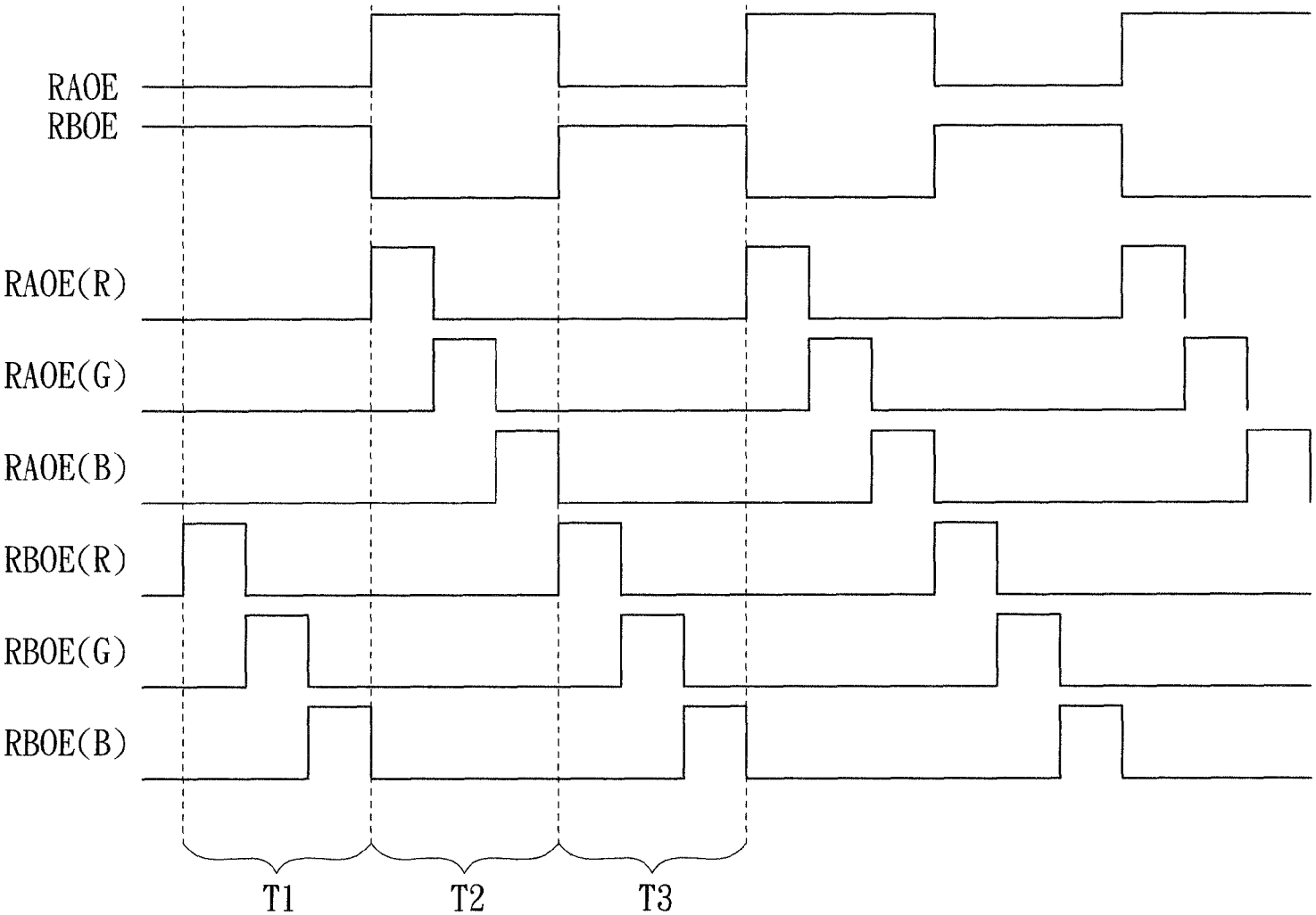
FIG. 7B is a timing chart showing output enable signals RAOE, RBOE, RAOE(R), RAOE(G), RAOE(B), RBOE(R), RBOE(G) and RBOE(B) according to an example of the preferred embodiment of the invention.

FIG. 7A is a timing chart showing the clock signals HCLK and HXCK, the starting signal HST the shift register signals HSR(1) to HSR(n), the first enable signal RASE, the second enable signal RBSE, and the input enable signals RAIE(1) to RAIE(n) and RBIE(1) to RBIE(n). FIG. 7B is a timing chart showing the output enable signals RAOE, RBOE, RAOE(R), RAOE(G), RAOE(B), RBOE(R), RBOE(G) and RBOE(B) according to an example of the preferred embodiment of the invention.

In the first period T1, the input enable signals RAIE(1) to RAIE(n) are sequentially enabled and the output enable signals RAOE(R), RAOE(G) and RAOE(B) are disabled. In a sub-period tn, the first latch unit 10(*n*) enables the sub-latch unit 11(*n*) to sample six bits of pixel data DR0 to DR5 according to the enabled input enable signal RAIE(n) and the disabled output enable signals RAOE(R), RAOE(G) and RAOE (B), enables the sub-latch unit 12(*n*) to sample six bits of pixel data DG0 to DG5, and enables the latch unit 13 to sample six bits of pixel data DB0 to DB5.

In the second period T2, the input enable signals RBIE(1) to RBIE(n) are sequentially enabled and the output enable signals RBOE(R), RBOE(G) and RBOE(B) are disabled. In the sub-period tn', the second latch unit 20(*n*) enables the sub-latch unit 24(*n*) to sample the six bits of pixel data DR0 to DR5, enables the sub-latch unit 25(*n*) to sample the six bits of pixel data DG0 to DG5, and enables the sub-latch unit 26(*n*) to sample the six bits of pixel data DB0 to DB5 according to the enabled input enable signal RBIE(n) and the disabled output enable signals RBOE(R), RBOE(G) and RBOE(B).

In the second period T2, the input enable signals RAIE(1) to RAIE(n) are disabled and the output enable signal RAOE (R) is first enabled to make the sub-latch unit 11(*n*) output the stored pixel data DR0 to DR5 to the digital-to-analog converting unit 46(*n*) via the transmission channel set 30(*n*). The transmission channel set 30 includes six transmission channels C0 to C5 correspondingly electrically coupled to six D-flip flops of the sub-latch unit 11(*n*) to respectively transmit the pixel data DR0 to DR5 to the digital-to-analog converting unit 46(*n*).

Next, the output enable signals RAOE(G) and RAOE(B) are sequentially enabled, and the input enable signals RAIE (1) to RAIE(n) are disabled so that the pixel data DG0 to DG5 and DB0 to DB5 stored in the sub-latch units 12(*n*) and 13(*n*) are sequentially outputted to the digital-to-analog converting unit 46(*n*) via the transmission channel set 30(*n*). The detailed circuit operation is the same as that of the sub-latch unit 11(*n*), and detailed descriptions thereof will be omitted.

In the third period T3, the output enable signal RBOE(R) is first enabled and the input enable signals RBIE(1) to RBIE(n) are disabled so that the sub-latch unit 24(*n*) outputs the stored pixel data DR0 to DR5 to the digital-to-analog converting unit 46(*n*) via the transmission channel set 30(*n*). The transmission channels C0 to C5 are correspondingly electrically coupled to six D-flip flops of the sub-latch unit 24(*n*) to transmit the pixel data DR0 to DR5 to the digital-to-analog converting unit 46(*n*).

Next, the output enable signals RBOE(G) and RBOE(B) are sequentially enabled and the input enable signals RBIE(1) to RBIE(n) are disabled so that the pixel data DG0 to DG5 and DB0 to DB5 stored in the sub-latch units 25(*n*) and 26(*n*) are sequentially outputted to the digital-to-analog converting unit 46(*n*) via the transmission channel set 30(*n*).

Preferably, the second period T2 follows the first period T1, the third period T3 follows the second period T2, and the length of the first period T1, the second period T2 and the third period T3 is substantially equal to a line time. In addition and preferably, in the first period T1, the sub-latch units 11(*n*) to 13(*n*) simultaneously and respectively sample the pixel data DR0 to DR5, DG0 to DG5 and DB0 to DB5. In the second period T2, the sub-latch units 24(*n*) to 26(*n*) simultaneously and respectively sample the pixel data DR0 to DR5, DG0 to DG5 and DB0 to DB5. The pixel data DR0 to DR5 respectively represent one bit of red pixel data, the pixel data DG0 to DG5 respectively represent one bit of green pixel data, and the pixel data DB0 to DB5 respectively represent one bit of blue pixel data.

Figure 8A:
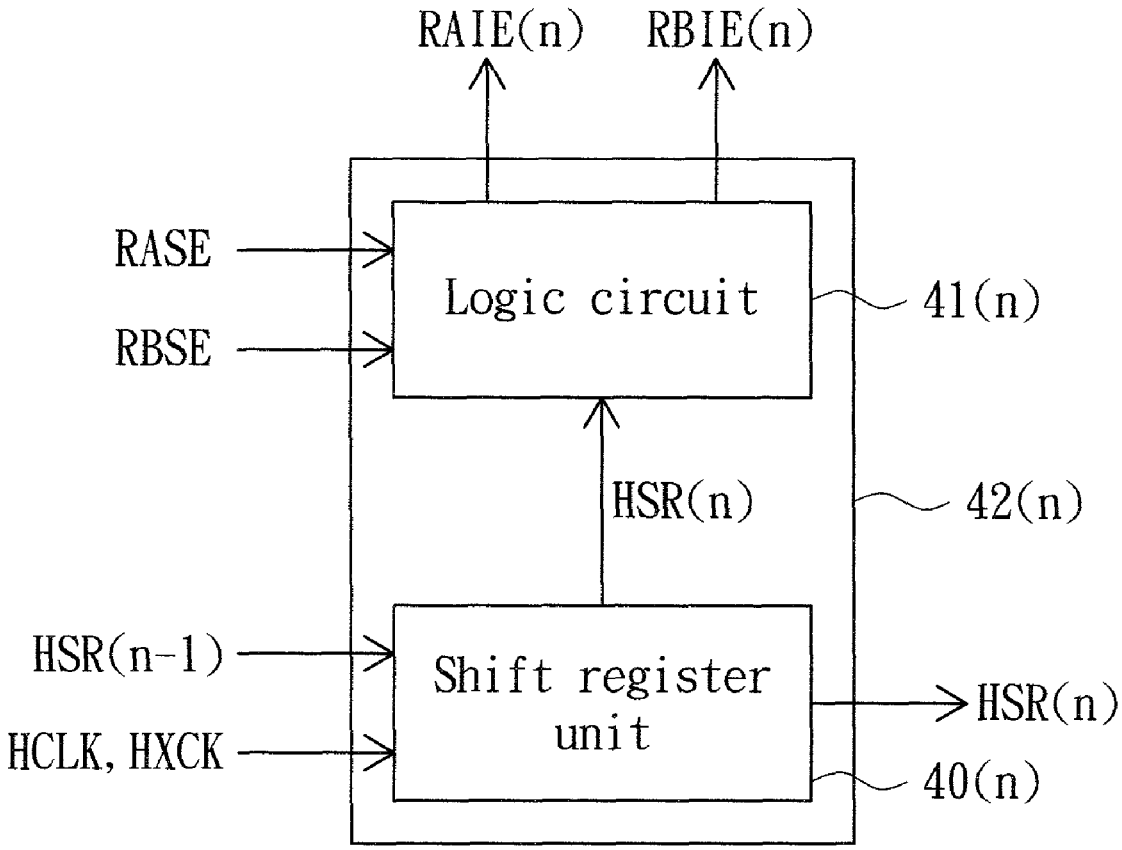
FIG. 8A is a block diagram showing a data sampling controller according to the preferred embodiment of the invention.
Figure 8B:
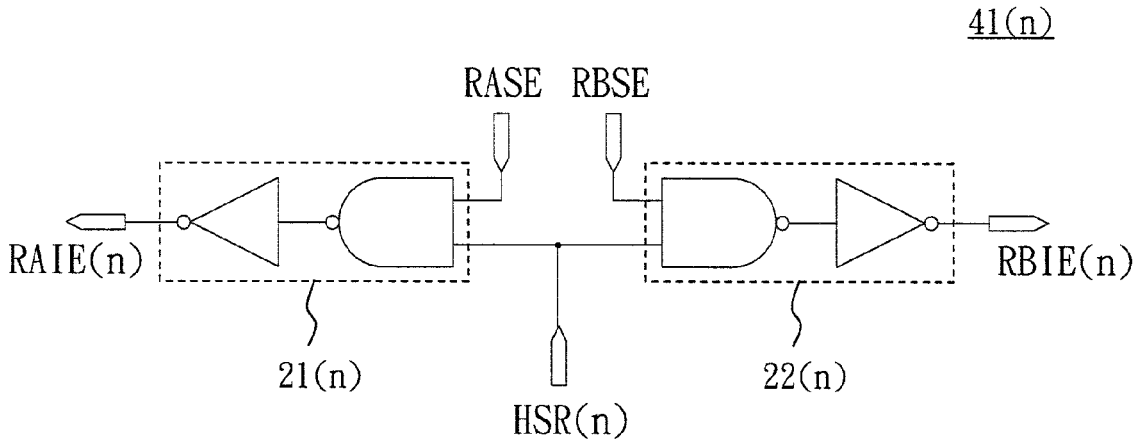
FIG. 8B is a circuit diagram showing an example of a logic circuit of FIG. 8A.

FIG. 8A is a block diagram showing a data sampling controller according to the preferred embodiment of the invention. As shown in FIG. 8A, for example, the data sampling controller 42(*n*) includes a shift register unit 40(*n*) and a logic circuit 41(*n*). FIG. 8B is a circuit diagram showing an example of the logic circuit 41(*n*) of FIG. 8A. In the sub-period tn', the shift register unit 40(*n*) receives the clock signals HCLK and HXCK and a previous stage of shift register signal HSR(n−1), and thus generates the stage of shift register signal HSR(n). The logic circuit 41(*n*) includes a first logic unit 21(*n*) and a second logic unit 22(*n*). The first logic unit 21(*n*) receives the first actuating signal RASE and the stage of shift register signal HSR(n), and thus generates the input enable signal RAIE(n). The second logic unit 22(*n*) receives the second actuating signal RBSE and the stage of shift register signal HSR(n), and thus generates the input enable signal RBIE(n). As shown in FIG. 8B, the first logic unit 21(*n*) and the second logic unit 22(*n*) may be respectively implemented by a NAND gate and a phase inverter connected in series.

Figure 8C:
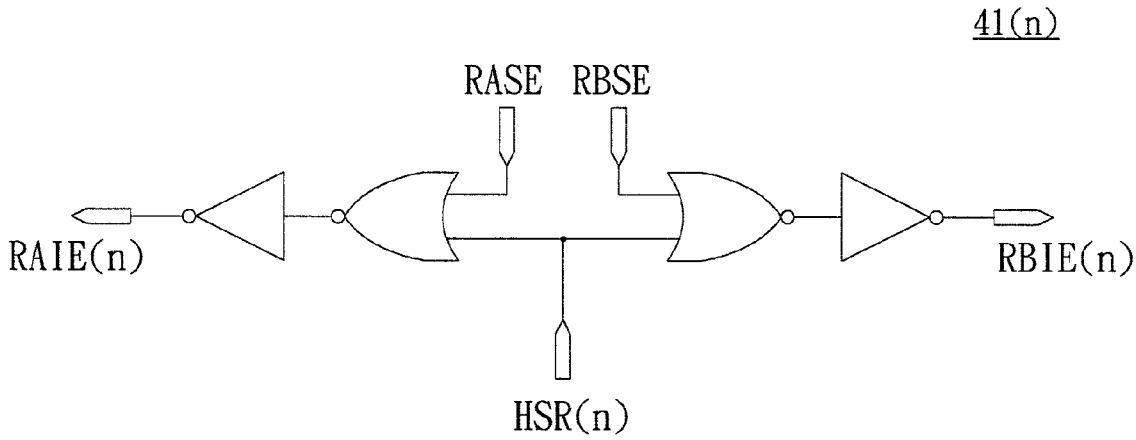
FIG. 8C is a circuit diagram showing another example of the logic circuit using NOR gates according to the preferred embodiment of the invention.

Referring simultaneously to FIGS. 8A and 7A, the first actuating signal RASE is enabled and the shift register signals HSR(1) to HSR(n) are sequentially enabled in the first period T1 so that the input enable signals RAIE(1) to RAIE(n) outputted from the first logic units 21(1) to 21(*n*) are sequentially enabled. In the second period T2, the second actuating signal RBSE is enabled and the shift register signals HSR(1) to HSR(n) are sequentially enable so that the input enable signals RBIE(1) to RBIE(n) outputted from the second logic units 22(1) to 22(*n*) are sequentially enabled. The NAND gates of the first logic unit 21 and the second logic unit 22 may be replaced with NOR gates. FIG. 8C is a circuit diagram showing another example of the logic circuit logic circuit 41(*n*) using the NOR gates according to the preferred embodiment of the invention.

Figure 1:
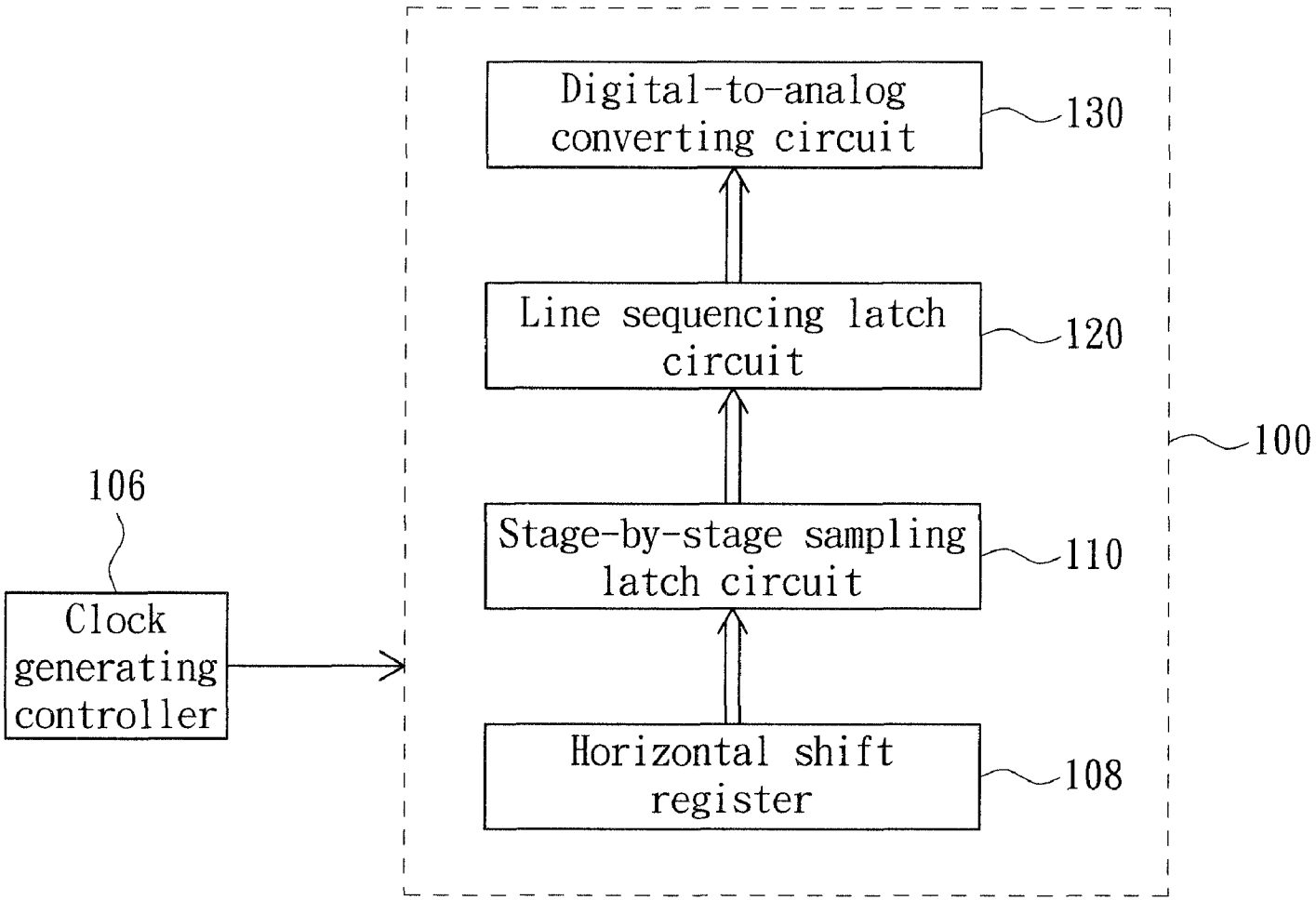
FIG. 1(RELATED ART)
FIG. 1 (Related Art) is an internal block diagram showing a conventional source driver circuit.
Figure 2:
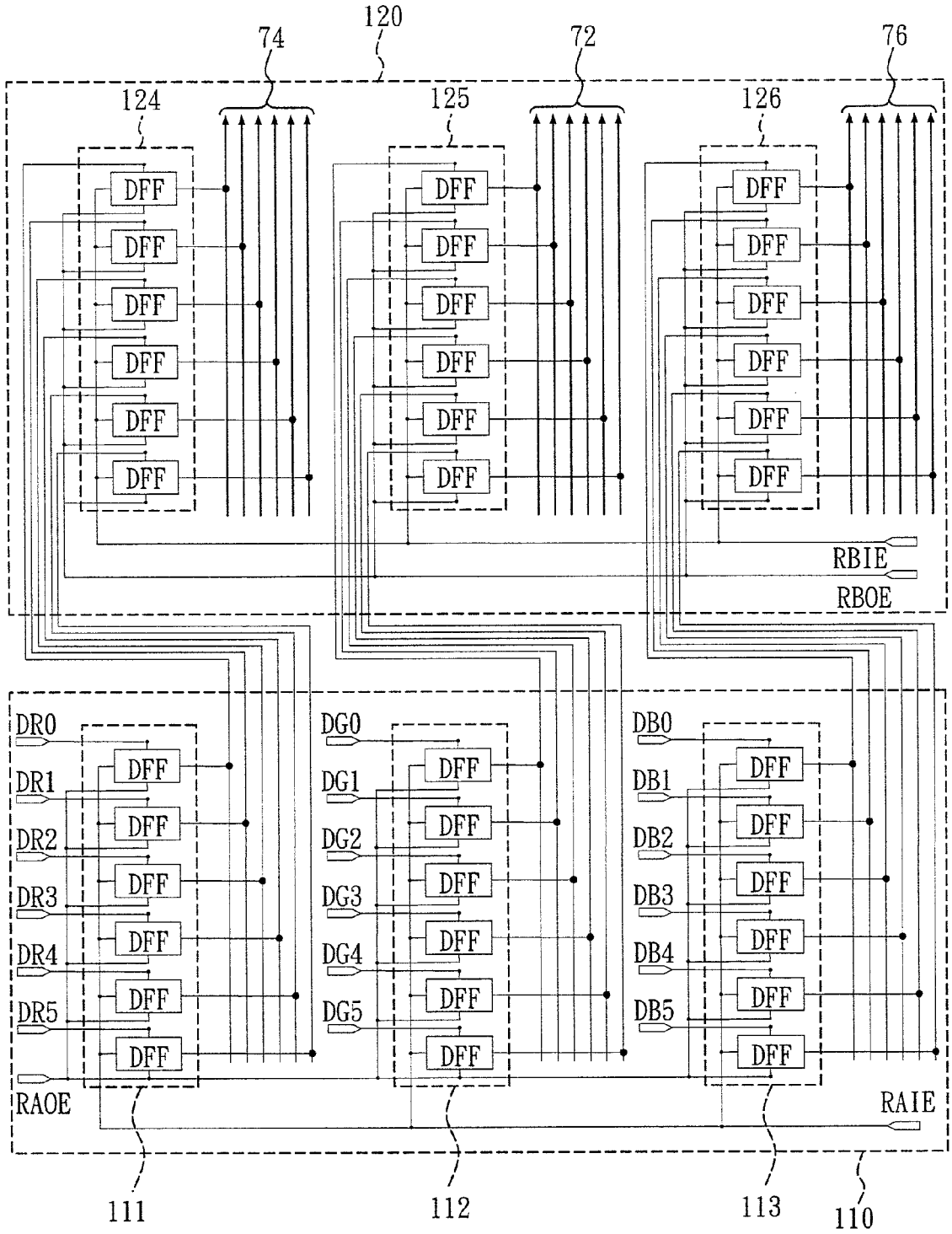
FIG. 2(RELATED ART)
FIG. 2 (Related Art) is an internal block diagram showing a stage-by-stage sampling latch circuit and a line sequencing latch circuit according to the prior art.

When the sampling-transmitting unit 44(*n*) of FIG. 5A or 6 is being used, the required number of transmission channels is much smaller than that of the transmission channels in the prior art of FIG. 2 so that the area of the circuit layout can be reduced. The sampling-transmitting unit 44(*n*) of FIG. 6 will be illustrated as an example. Referring simultaneously to FIGS. 4 and 6, when all the second latch units 20(1) to 20(*n*) of the sampling-transmitting units 44(1) to 44(*n*) sequentially receive the pixel data, the received first to third output enable signals RAOE(R), RAOE(G) and RAOE(B) of all the first latch units 10(1) to 10(*n*) are sequentially enabled so that all the sub-latch units 11(1) to 11(*n*) simultaneously output the six bits of red pixel data to the digital-to-analog converting units 46(1) to 46(*n*) via the transmission channel sets 30(1) to 30(*n*). Thereafter, all the sub-latch units 12(1) to 12(*n*) simultaneously output the six bits of green pixel data to the digital-to-analog converting unit via the transmission channel sets 30(1) to 30(*n*). Then, all the sub-latch units 13(1) to 13(*n*) simultaneously output the six bits of blue pixel data to the digital-to-analog converting units 46(1) to 46(*n*) via the transmission channel sets 30(1) to 30(*n*). Consequently, if the resolution of the display area 310 is 240 (i.e., the number of columns of pixels is equal to 240*3) on a mobile phone display of the wide viewing angle display screen, only 1440 (=240 (resolution)*6 (number of channels)) transmission channels are needed to complete the data transmission. Compared with the prior art, in which 240*3*6=4320 transmission channels are needed on the display area with the same resolution, the embodiment greatly decreases the number of transmission channels. So, the area of the circuit layout can be effectively reduced.

The liquid crystal display panel according to the embodiment of the invention includes the following advantages. In the source driver circuit of this embodiment, all pixel data in the sampling-transmitting units may share the same transmission channel (e.g., 6 bits of transmission channels) because the time-sharing and multiplex data transmitting method is adopted. Compared with the prior art, in which 18 bits of transmission channels are required, the source driver circuit of this embodiment can effectively reduce the total number of the transmission channels and thus save the layout area. Because the shared channels can greatly save the complicated circuit layout, the integration of the circuit may be increased. Thus, the liquid crystal display panel according to this embodiment of the invention can be applied to the high resolution display apparatus, and can have the better system integrating ability, the low cost and the high reliability.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A source driver circuit for use in a display panel, the source driver circuit comprising:

a plurality of digital-to-analog converting units; and a plurality of sampling-transmitting units, each of the sampling-transmitting units comprising:

a first latch unit comprising a first sub-latch unit for receiving a first input enable signal and a first output enable signal and a second sub-latch unit for receiving a second input enable signal and a second output enable signal, wherein the first and second input enable signals are enabled in a first period, and the first and second output enable signals are disabled so that the first sub-latch unit and the second sub-latch unit samples first pixel data and second pixel data, respectively;

a second latch unit comprising a third sub-latch unit for receiving a third input enable signal and a third output enable signal and a fourth sub-latch unit for receiving a fourth input enable signal and a fourth output enable signal, wherein the third and fourth input enable signals are enabled in a second period and the third and fourth output enable signals are disabled so that the third sub-latch unit and the fourth sub-latch unit samples third pixel data and fourth pixel data, respectively; and a transmission channel set for electrically coupling the first latch unit and the second latch unit to the corresponding digital-to-analog converting unit, wherein:

in the second period, the first and second output enable signals are sequentially enabled, and the first and second input enable signals are disabled so that the first sub-latch unit and the second sub-latch unit sequentially output the first pixel data and the second pixel data to the corresponding digital-to-analog converting unit via the transmission channel set; and in a third period, the third and fourth output enable signals are sequentially enabled and the third and fourth input enable signals are disabled so that the third sub-latch unit and the fourth sub-latch unit sequentially output the third pixel data and the fourth pixel data to the corresponding digital-to-analog converting unit via the transmission channel set.

2. The source driver circuit according to claim 1, wherein the second period follows the first period, the third period follows the second period and a length of the first period, the second period and the third period is substantially equal to a line time.

3. The source driver circuit according to claim 1, wherein in the third period, the first and second input enable signals are enabled and the first and second output enable signals are disabled so that the first sub-latch unit and the second sub-latch unit respectively sample seventh pixel data and eighth pixel data.

4. The source driver circuit according to claim 1, wherein:

in the first period, the first and second input enable signals are simultaneously enabled so that the first sub-latch unit and the second sub-latch unit simultaneously and respectively sample the first pixel data and the second pixel data; and in the second period, the third and fourth input enable signals are simultaneously enabled so that the third sub-latch unit and the fourth sub-latch unit simultaneously and respectively sample the third pixel data and the fourth pixel data.

5. The source driver circuit according to claim 1, wherein:

the first latch unit further comprises a fifth sub-latch unit for receiving a fifth input enable signal and a fifth output enable signal, the fifth input enable signal is enabled in the first period so that the fifth sub-latch unit samples fifth pixel data, the second latch unit further comprises a sixth sub-latch unit for receiving a sixth input enable signal and a sixth output enable signal, and the sixth input enable signal is enabled in the second period so that the sixth sub-latch unit samples sixth pixel data;

after the first and second output enable signals are sequentially enabled in the second period, the fifth output enable signal is enabled and the fifth input enable signal is disabled so that the fifth sub-latch unit outputs the fifth pixel data to the corresponding digital-to-analog converting unit via the transmission channel set;

after the third and fourth output enable signals are sequentially enabled in the third period, the sixth output enable signal is enabled and the sixth input enable signal is disabled so that the sixth sub-latch unit outputs the sixth pixel data to the corresponding digital-to-analog converting unit via the transmission channel set; and the first pixel data and the third pixel data are red pixel data, the second pixel data and the fourth pixel data are green pixel data, and the fifth pixel data and the sixth pixel data are blue pixel data.

6. The source driver circuit according to claim 1, wherein:

in the first period, the first input enable signals received by all the sampling-transmitting units are sequentially enabled, and the second input enable signals and the corresponding first input enable signal pertaining to the same sampling-transmitting unit are simultaneously enabled; and in the second period, the third input enable signals received by all the sampling-transmitting units are sequentially enabled, and the fourth input enable signals and the corresponding third input enable signal pertaining to the same sampling-transmitting unit are simultaneously enabled.

7. The source driver circuit according to claim 1, wherein:

in the second period, the first output enable signals of all the sampling-transmitting units are simultaneously enabled so that all the first pixel data are outputted, and then the second output enable signals of all the sampling-transmitting units are enabled so that all the second pixel data are outputted; and in the third period, the third output enable signals of all the sampling-transmitting units are enabled so that all the third pixel data are outputted, and then the fourth output enable signals of all the sampling-transmitting units are enabled so that all the fourth pixel data are outputted.

8. The source driver circuit according to claim 1, further comprising a plurality of data sampling controllers, each of which comprises:

a shift register unit for receiving a clock signal and thus outputting a shift register signal; and a logic circuit, which comprises:

a first logic unit for receiving a first actuating signal and the shift register signal and thus generating the first input enable signal; and a second logic unit for receiving a second actuating signal and the shift register signal and thus generating the second input enable signal, wherein the shift register signals outputted from the shift register units are sequentially enabled, the first actuating signal is enabled in the first period so that the first input enable signals outputted from the first logic units are sequentially enabled, and the second actuating signal is enabled in the second period so that the second input enable signals outputted from the second logic units are sequentially enabled.

9. The source driver circuit according to claim 1, wherein each of the first to fourth pixel data has N bits, the transmission channel set comprises N transmission channels, and N is a positive integer.

10. A display panel, comprising:

a pixel array, which comprises a plurality of row pixels;

a timing controller for generating a clock signal, a first actuating signal and a second actuating signal;

a vertical driver circuit, electrically coupled to one side of the pixel array, for sequentially providing a scan voltage to the row pixels to turn on the corresponding pixel; and a source driver circuit, which is electrically coupled to the other side of the pixel array and comprises:

a plurality of digital-to-analog converting units; and a plurality of sampling-transmitting units each comprising:

a first latch unit, which comprises a first sub-latch unit for receiving a first input enable signal and a first output enable signal, and a second sub-latch unit for receiving a second input enable signal and a second output enable signal, wherein the first and second input enable signals are enabled in a first period, and the first and second output enable signals are disabled so that the first sub-latch unit and the second sub-latch unit sample first pixel data and second pixel data, respectively;

a second latch unit, which comprises a third sub-latch unit for receiving a third input enable signal and a third output enable signal, and a fourth sub-latch unit for receiving a fourth input enable signal and a fourth output enable signal, wherein the third and fourth input enable signals are enabled in a second period and the third and fourth output enable signals are disabled so that the third sub-latch unit and the fourth sub-latch unit sample third pixel data and fourth pixel data, respectively; and a transmission channel set for electrically coupling the first latch unit and the second latch unit to the corresponding digital-to-analog converting unit, wherein:

in the second period, the first and second output enable signals are sequentially enabled, and the first and second input enable signals are disabled so that the first sub-latch unit and the second sub-latch unit sequentially output the first pixel data and the second pixel data to the corresponding digital-to-analog converting unit via the transmission channel set; and in a third period, the third and fourth output enable signals are sequentially enabled and the third and fourth input enable signals are disabled so that the third sub-latch unit and the fourth sub-latch unit are sequentially enabled to sequentially output the third pixel data and the fourth pixel data to the corresponding digital-to-analog converting unit via the transmission channel set.

11. The display panel according to claim 10, wherein the second period follows the first period, the third period follows the second period, and a length of the first period, the second period and the third period is substantially equal to a line time.

12. The display panel according to claim 10, wherein in the third period, the first and second input enable signals are enabled and the first and second output enable signals are disabled so that the first sub-latch unit and the second sub-latch unit are enabled to sample seventh pixel data and eighth pixel data.

13. The display panel according to claim 10, wherein:

in the first period, the first and second input enable signals are simultaneously enabled so that the first sub-latch unit and the second sub-latch unit simultaneously and respectively sample the first pixel data and the second pixel data; and in the second period, the third and fourth input enable signals are simultaneously enabled so that the third sub-latch unit and the fourth sub-latch unit simultaneously and respectively sample the third pixel data and the fourth pixel data.

14. The display panel according to claim 10, wherein:

the first latch unit further comprises a fifth sub-latch unit for receiving a fifth input enable signal and a fifth output enable signal, the fifth input enable signal is enabled in the first period so that the fifth sub-latch unit samples fifth pixel data, the second latch unit further comprises a sixth sub-latch unit for receiving a sixth input enable signal and a sixth output enable signal, and the sixth input enable signal is enabled in the second period so that the sixth sub-latch unit samples sixth pixel data;

after the first and second output enable signals are sequentially enabled in the second period, the fifth output enable signal is enabled and the fifth input enable signal is disabled so that the fifth sub-latch unit outputs the fifth pixel data to the corresponding digital-to-analog converting unit via the transmission channel set;

after the third and fourth output enable signals are sequentially enabled in the third period, the sixth output enable signal is enabled and the sixth input enable signal is disabled so that the sixth sub-latch unit is enabled to output the sixth pixel data to the corresponding digital-to-analog converting unit via the transmission channel set; and the first pixel data and the third pixel data are respectively red pixel data, the second pixel data and the fourth pixel data are respectively green pixel data, and the fifth pixel data and the sixth pixel data are respectively blue pixel data.

15. The display panel according to claim 10, wherein:

in the first period, the first input enable signals received by all the sampling-transmitting units are sequentially enabled, the second input enable signals and the corresponding first input enable signal pertaining to the same sampling-transmitting unit are simultaneously enabled; and in the second period, the third input enable signals received by all the sampling-transmitting units are sequentially enabled, and the fourth input enable signals and the corresponding third input enable signal pertaining to the same sampling-transmitting unit are simultaneously enabled.

16. The display panel according to claim 10, wherein:

in the second period, the first output enable signals of all the sampling-transmitting units are simultaneously enabled so that all the first pixel data are outputted, and then the second output enable signals of all the sampling-transmitting units are enabled so that all the second pixel data are outputted; and in the third period, the third output enable signals of all the sampling-transmitting units are enabled so that all the third pixel data are outputted, and then the fourth output enable signals of all the sampling-transmitting units are enabled so that all the fourth pixel data are outputted.

17. The display panel according to claim 10, wherein the source driver circuit further comprises a plurality of data sampling controllers, each of which comprises:

a shift register unit for receiving the clock signal and thus outputting a shift register signal; and a logic circuit, which comprises:

a first logic unit for receiving the first actuating signal and the shift register signal and thus generating the first input enable signal; and a second logic unit for receiving the second actuating signal and the shift register signal and thus generating the second input enable signal;

wherein the shift register signals outputted from the shift register units are sequentially enabled, the first actuating signal is enabled in the first period so that the first input enable signals outputted from the first logic units are sequentially enabled, and the second actuating signal is enabled in the second period so that the second input enable signals outputted from the second logic units are sequentially enabled.

18. The display panel according to claim 10, wherein each of the first to fourth pixel data has N bits, the transmission channel set comprises N transmission channels, and N is a positive integer.

19. A source driver circuit for use in a display panel, the source driver circuit comprising:

a plurality of digital-to-analog converting units;

a plurality of sampling-transmitting units each comprising:

a first sub-latch unit for receiving a first input enable signal and a first output enable signal, wherein in a first period, the first input enable signal is enabled and the first output enable signal is disabled so that the first sub-latch unit samples first pixel data; a second sub-latch unit for receiving a second input enable signal and a second output enable signal, wherein in a second period, the second input enable signal is enabled and the second output enable signal is disabled so that the second sub-latch unit samples second pixel data; and a transmission channel set for electrically coupling the first sub-latch unit and the second sub-latch unit to the corresponding digital-to-analog converting unit, wherein in the second period, the first output enable signal is enabled and the first input enable signal is disabled so that the first sub-latch unit outputs the first pixel data to the corresponding digital-to-analog converting unit via the transmission channel set; and in a third period, the second output enable signal is enabled and the second input enable signal is disabled so that the second sub-latch unit outputs the second pixel data to the corresponding digital-to-analog converting unit via the transmission channel set; and a plurality of data sampling controllers each comprising: a shift register unit for receiving a clock signal and thus outputting a shift register signal; and a logic circuit, which comprises: a first logic unit for receiving a first actuating signal and the shift register signal and thus generating the first input enable signal; and a second logic unit for receiving a second actuating signal and the shift register signal and thus generating the second input enable signal, wherein the shift register signals outputted from the shift register units are sequentially enabled, the first actuating signal is enabled in the first period so that the first input enable signals outputted from the first logic units are sequentially enabled, and the second actuating signal is enabled in the second period so that the second input enable signals outputted from the second logic units are sequentially enabled.

20. The circuit according to claim 19, wherein the second period follows the first period, the third period follows the second period, and a length of the first period, the second period and the third period is substantially equal to a line time.

21. The circuit according to claim 19, wherein each of the first and second pixel data has N bits, the transmission channel set comprises N transmission channels, and N is a positive integer.

* * * * *